US006845719B1

(12) United States Patent
Spencer

(10) Patent No.: US 6,845,719 B1
(45) Date of Patent: Jan. 25, 2005

(54) EROSION RESISTANT PROJECTILE

(75) Inventor: William R. Spencer, Longwood, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/456,644

(22) Filed: Jun. 5, 2003

(51) Int. Cl.[7] ..... F42B 10/00
(52) U.S. Cl. ..... 102/519
(58) Field of Search ..... 102/519

(56) References Cited

U.S. PATENT DOCUMENTS

| | | | | | |
|---|---|---|---|---|---|
| 243,334 | A | * | 6/1881 | Whitney | 102/519 |
| 740,977 | A | * | 10/1903 | Hamilton | 102/519 |
| 945,492 | A | * | 1/1910 | Davis | 102/519 |
| 968,012 | A | * | 8/1910 | Wheeler et al. | 102/519 |
| 1,027,964 | A | * | 5/1912 | Yingling | 102/519 |
| 1,069,237 | A | * | 8/1913 | Douglas | 102/519 |
| 1,112,044 | A | * | 9/1914 | Watson | 102/519 |
| 1,132,453 | A | * | 3/1915 | Davis | 102/519 |
| 1,149,602 | A | * | 8/1915 | Strange | 102/519 |
| 1,172,511 | A | * | 2/1916 | Allan | 102/519 |
| 1,301,859 | A | * | 4/1919 | McKenna et al. | 102/519 |
| 1,312,762 | A | * | 8/1919 | Strang | 102/519 |
| 1,398,229 | A | * | 11/1921 | Hadfield et al. | 102/519 |
| 1,419,361 | A | * | 6/1922 | Cox | 102/519 |
| 2,343,344 | A | * | 3/1944 | Thompson | 102/519 |
| 2,393,648 | A | * | 1/1946 | Martin | 102/519 |
| 2,401,380 | A | * | 6/1946 | Teitscheid | 102/519 |
| 3,203,349 | A | * | 8/1965 | Schonberg | 102/519 |
| 3,302,570 | A | * | 2/1967 | Marquardt | 102/519 |
| 3,877,380 | A | * | 4/1975 | Riparbelli | 102/519 |
| 4,753,172 | A | * | 6/1988 | Katzmann et al. | 102/519 |
| 5,064,462 | A | * | 11/1991 | Mullendore et al. | 102/519 |
| 6,085,661 | A | * | 7/2000 | Halverson et al. | 102/519 |
| 6,186,072 | B1 | * | 2/2001 | Hickerson, Jr. et al. | 102/519 |
| 6,374,743 | B1 | * | 4/2002 | Hug et al. | 102/519 |
| 6,530,328 | B2 | * | 3/2003 | Burczynski et al. | 102/519 |

FOREIGN PATENT DOCUMENTS

| | | | | |
|---|---|---|---|---|
| CH | 0197329 | * | 7/1938 | 102/519 |

* cited by examiner

*Primary Examiner*—Harvey E. Behrend
(74) *Attorney, Agent, or Firm*—Jeffrey D. Myers; Peacock, Myers & Adams, P.C.

(57) ABSTRACT

A projectile and corresponding method of manufacture comprising a body comprising a structural material and a nose cap comprising a primary nose cap material attached to and having a different composition from the body structural material and a secondary nose cap material attached to the primary nose cap material and comprising the tip of the nose cap and having a different composition from both the body structural material and the primary nose cap material.

3 Claims, 1 Drawing Sheet

EROSION RESISTANT PROJECTILE

BACKGROUND OF THE INVENTION

1. Field of the Invention (Technical Field)

The present invention relates to high performance, high velocity, hard target penetrating warhead cases and other high velocity projectiles, such as anti-armor devices.

2. Background Art

In order to achieve significant penetration performance increases over conventional high strength steel warhead cases, high density structural alloys such as tungsten heavy alloys (WHA) and/or the boosting of the warhead to high impact velocities have been employed. WHA alloys are metal-matrix composite materials with compositions of about 80% to 97% by weight tungsten with the balance being some combination of nickel, iron, and/or cobalt. During the liquid phase sintering (LPS) consolidation process, the tungsten forms into small solid particles surrounded by a liquid, steel-like matrix alloy composed of the nickel, iron, and/or cobalt with a substantial amount of dissolved tungsten.

The drawbacks of using LPS WHA are that high strength necessary to survive oblique impact conditions is difficult to achieve and the hardness of the material is low. The use of velocities significantly higher than the 1000 to 1100 ft/s typical of ballistic warheads results in erosion of the nose surface in both steel and WHA cases due to melting and hot shearing of the nose material. This erosion leads to loss of penetration performance and possible deviation from a straight path due to erosion asymmetry.

The present invention provides materials and methods of manufacture that overcome the above problems and provides a non-eroding, high performance penetrator capability.

SUMMARY OF THE INVENTION (DISCLOSURE OF THE INVENTION)

The present invention is of a projectile (and corresponding method of manufacture) comprising: a body comprising a structural material; and a nose cap comprising: a primary nose cap material attached to and having a different composition from the body structural material; and a secondary nose cap material attached to the primary nose cap material and comprising the tip of the nose cap and having a different composition from both the body structural material and the primary nose cap material. In the preferred embodiment, the body comprises steel and/or WHA. Preferred embodiments of the body form the body of WHA formed by cold isostatic pressing (most preferably of approximately 5 micron elemental powders), followed by solid state sintering, followed by liquid phase sintering, or by cold isostatic pressing (most preferably of approximately elemental particles of sizes less than approximately 0.1 micron), followed by solid state sintering, followed by hot isostatic pressing. The primary nose cap material comprises a hard refractory material comprising one or more compounds selected from tungsten carbide, titanium carbide, titanium diboride, zirconium diboride, tantalum carbide, tantalum diboride, silicon carbide, and boron carbide, preferably sintered tungsten carbide, and most preferably WC/Co and/or WC/Ni. The secondary nose cap material comprises a hard refractory material comprising one or more compounds selected from titanium carbide, titanium diboride, zirconium diboride, tantalum carbide, tantalum diboride, silicon carbide and boron carbide, preferably pure tungsten carbide. The secondary nose cap may also comprise a layer formed over the primary nose cap material and/or a rod inserted into the primary nose cap material.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DESCRIPTION OF THE PREFERRED EMBODIMENTS

BEST MODES FOR CARRYING OUT THE INVENTION

Figure 1:
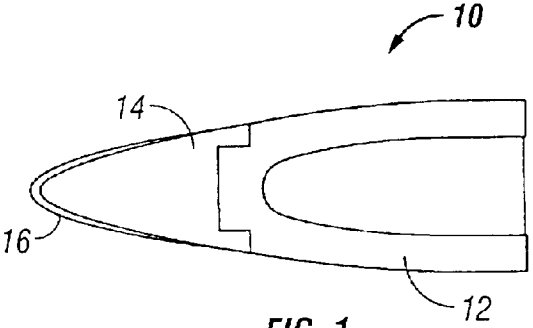
FIG. 1 is a cross-sectional diagram of an embodiment of the invention employing a surface layer of hard refractory compound.

The present invention is of high performance, erosion resistant penetrating projectiles (e.g., warhead cases) and methods of manufacturing same. The invention comprises a body of high strength metallic material (preferably steel or tungsten heavy alloy (WHA)) with a nose cap of a hard refractory compound (preferably a sintered carbide).

One embodiment of the invention employs a WHA body joined to a sintered tungsten carbide (preferably WC/Ni or WC/Co) composite nose cap that is coated with a pure WC surface layer. Another embodiment of the invention utilizes a heat treated, high strength steel body joined to a sintered tungsten carbide composite nose cap that is coated with a pure WC surface layer. A further embodiment employs a WHA or high strength steel body joined to a sintered tungsten carbide composite nose cap that is coated with a pure WC surface layer and has an axial tip rod-like insert of pure WC at the nose tip. Other embodiments utilize hard refractory compounds other than WC for the surface layer or insert.

The erosion of the nose surface in both steel and WHA cases of high velocity, non-ballistic warheads is the result of mechanical abrasion, hot shearing, and/or melting of the nose material. In order to eliminate this, the surface and near surface material of the nose must be composed of materials that have certain mechanical and thermal properties. The preferred mechanical properties include a high hardness and strength (to resist mechanical abrasion), a high elastic modulus, and adequate impact toughness. The thermal properties include a high hot hardness and strength and a high melting point, i.e., significantly higher than the media that is being penetrated, which is usually about 1700° C. The erosion resistant materials must also be compatible in terms of coefficient of thermal expansion (CTE) and, to a lesser degree, modulus of elasticity, with the materials adjacent to them, in particular the body structural material.

The present invention employs a nose cap comprising hard and refractory materials joined to the penetrator projectile body, which materials can be a base material with a surface coating and/or nose tip rod insert. The composition of the nose cap base material(s) are preferably designed to meet the above compatibility requirements and provide adequate mechanical support to the nose surface material and/or the rod material. The composition and thickness of the joining materials are preferably designed to meet the compatibility requirements between the nose cap base material and the penetrator body and the rod insert if present. The shape of the joint surface is preferably designed to provide the proper support to the nose cap and/or the rod insert, so as to prevent destructively high tensile stresses in the materials during penetration. The joining material and process may be one of several methods known in the art, including adhesive bonding, brazing, diffusion bonding, and/or mechanical retention. The nose surface material (and the optional rod insert material) composition and thickness is designed not only to meet the mechanical and thermal requirements to resist erosion but also to form a temperature gradient sufficient to prevent softening or melting of the nose cap base material. A proper materials and joint design for a particular application will assure that the nose materials will survive the penetration event without fracturing, spalling, or mechanical removal due to property mismatch with the body material.

Figure 2:
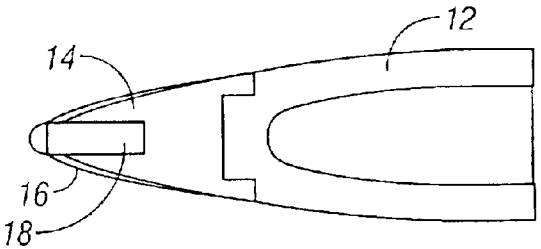
FIG. 2 is a cross-sectional diagram of an embodiment of the invention employing a nose tip rod insert of hard refractory compound.
Figure 3:
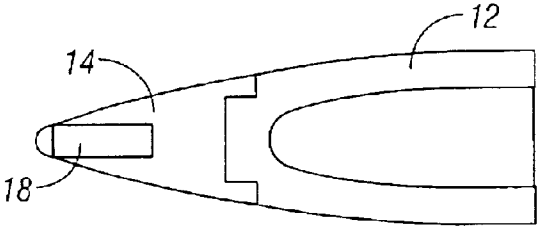
FIG. 3 is a cross-sectional diagram of an embodiment of the invention employing both a surface layer of hard refractory compound and a nose tip rod insert of hard refractory compound.

Referring to FIGS. 1–3, nine embodiments of the invention are next presented.

A first embodiment 10 of the invention, shown in FIG. 1, employs WHA containing preferably about 80% to 97% tungsten in the LPS condition for the body structural material 12. The WHA materials are preferably produced by a three-step consolidation process from about 5 micron elemental powders of W, Ni, and Fe and/or Co. The powder mix is first cold isostatically pressed (CIP) to about 60% density, then solid state sintered (SSS) to about 95% density, and finally LPS processed to full density. The LPS material is preferred for applications with benigh impact angle conditions since this material has a relatively low yield strength of about 90 ksi. For this embodiment, the nose cap primary material 14 preferably comprises sintered tungsten carbide (most preferably WC/Co or WC/Ni) with a secondary material 16 surface layer of pure WC, which has a melting point of 2630° C. This layer is preferably deposited by chemical vapor deposition (CVD) or by plasma spray, flame spray, or equivalent process that produces near full density.

A second embodiment is similar to the first except that it utilizes nanomaterials (particle sizes less than approximately 100 nm or 0.1 micron) for the elemental powder constituents of the WHA body rather than conventional micon-sized powders. Also, the final consolidation to near full density is preferably achieved by hot isostatic pressing (HIP) rather than LPS, which produces more than double the strength in the WHA body. This embodiment is preferred for applications with more stressing impact angle conditions since yield strengths of 200 ksi or more can be achieved.

A third embodiment is similar to the first except that it utilizes a heat treated, high strength steel for the body structural material. This would be for applications with yet more stressing impact angle conditions since yield strengths up to 350 ksi can be achieved.

Referring to FIG. 2, embodiments four, five, and six are similar to the first three except for the addition of a rod-like nose tip insert 18 of pure or single crystal refractory compound material as an additional secondary nose tip material.

Referring to FIG. 3, embodiments seven, eight, and nine are similar to embodiments four, five, and six except that there is no surface layer of pure refractory compound material.

The above embodiments can be modified by replacing WC with another hard refractory compound or compounds, such as titanium carbide, titanium diboride, zirconium diboride, tantalum carbide, tantalum diboride, silicon carbide, and boron carbide.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A projectile comprising:

a substantially conically shaped body comprising steel; and a nose cap comprising:

a primary nose cap material disposed on a terminal portion of said body and comprising a hard refractory material comprising tungsten carbide; and a secondary nose cap material attached to said primary nose cap material and comprising the tip of the nose cap, the secondary nose cap comprising tungsten carbide and substantially encapsulating the primary nose cap material.

2. The projectile of claim 1 wherein said primary nose cap material comprises sintered tungsten carbide.

3. The projectile of claim 2 wherein said primary nose cap material comprises WC/Co.

* * * * *